US005335797A

United States Patent [19]

Myers

[11] Patent Number: 5,335,797

[45] Date of Patent: Aug. 9, 1994

[54] MANUAL PAPER MANAGEMENT SYSTEM

[75] Inventor: Raymond L. Myers, Endicott, N.Y.

[73] Assignee: Ray Myers Corporation, Endicott, N.Y.

[21] Appl. No.: 980,631

[22] Filed: Nov. 23, 1992

[51] Int. Cl.[5] ..... A47F 5/00

[52] U.S. Cl. ..... 211/50; 211/88; 211/103; 211/90; 248/220.3

[58] Field of Search ..... 211/50, 87, 88, 90, 211/10, 103; 248/220.3, 220.4, 221.1, 221.2, 221.4

[56] References Cited

U.S. PATENT DOCUMENTS

| | | | |
|---|---|---|---|
| 1,155,763 | 10/1915 | Shirley . | |
| 1,966,555 | 11/1929 | Rack . | |
| 3,178,029 | 10/1962 | Meyers . | |
| 3,880,390 | 4/1975 | Niven | 248/221.2 |
| 3,971,475 | 7/1976 | Hodges . | |
| 4,034,864 | 7/1977 | Tyson et al. . | |
| 4,126,230 | 11/1978 | Tyson et al. . | |
| 4,438,852 | 3/1984 | Evans . | |
| 4,540,222 | 9/1985 | Burrell . | |
| 4,949,853 | 8/1990 | Klein et al. . | |
| 5,123,549 | 6/1992 | Finses et al. | 211/94 X |
| 5,197,614 | 3/1993 | Dalton et al. | 211/50 X |

FOREIGN PATENT DOCUMENTS

| | | | |
|---|---|---|---|
| 221202 | 10/1957 | Australia | 248/222.4 |
| 271447 | 3/1964 | Australia | 248/220.4 |
| 2026850 | 2/1980 | United Kingdom | 248/220.4 |

*Primary Examiner*—Robert W. Gibson, Jr.
*Attorney, Agent, or Firm*—Cumpston & Shaw

[57] ABSTRACT

A manual paper management system for identification and processing of documents and organization of workstation miscellany including a number of trays called paper devices and assist devices, a display or support panel for supporting any combination of the various trays, a product development form for planning and layout of the paper management system hardware, and a template for making line drawings of the paper management system on the product development form to simulate the layout of the paper management system. The support panel has a modular square grid inscribed on its surface and apertures at the intersection of each of the grid lines for hanging the paper devices and assist devices from the panel. Paper device trays are left or right handed with a J-shaped cross section, and hang diagonally with respect to the support panel grid. Assist device trays have square U-shaped cross sections and hang squarely with respect to the support panel grid. Both tray type devices have tabs extending from their rear surfaces which engage the apertures of the support panel. The shape, orientation, and position of the trays on the support panel provide for the identification and processing of documents and organization of various work station items.

34 Claims, 10 Drawing Sheets

MANUAL PAPER MANAGEMENT SYSTEM

BACKGROUND OF THE INVENTION

1. Field of the Invention

This invention relates to a manual paper management system and more particularly to the means for laying out the particular configuration of a paper management system, the hardware to construct and realize a finished paper management system, and a method for paper management.

In professional, industrial, business, and other types of offices, one problem which has plagued the operation of such offices is the rehandling of documents which are in the "active" state, i.e. documents that are being used and worked on but need temporary storage, and which occurs when such documents need to be located for processing. Those documents that have an active status are typically grouped together in a letter tray, or at a particular area of a work surface, and such grouping requires the user to scan the entire quantity of documents in order to find the one relevant at the time. This rehandling of already handled paper represents wasted production time. Thus, there is a need for a physical paper handling system which eliminates wasteful re handling of paper and which promotes functional convenience over structure.

2. Description of the Related Art

Various paper organization and management systems and the hardware with which to implement these systems are known in the art. For example, Myers U.S. Pat. No. 3,178,029 describes a card file for holding various size packs of cards on readily adjustable and arrangeable shelves. A back wall, at least 2 vertical side walls, and one or more intermediate or divider side walls can be arranged between the outer side walls to form several open compartments for cards. A variety of card supports or shelves can be mounted in various arrangements between the opposed side walls of the card file compartments.

Hodges U.S. Pat. No. 3,971,475 shows a paper handling system in which trays are suspended on a support panel. Trays with bottom, back, and side walls, are hung from slots in a support panel. Hodges also claims a rigid insert sheet member for providing greater surface area of his paper trays.

Klein et al. U.S. Pat. No. 4,949,853 relates to a convertible desk top organizer. This organizer requires vertical side panels and corner trays, and shelves having slots for dividers which engage the slots.

Tyson U.S. Pat. No. 4,034,864 relates to a document handling system in which a plurality of trays of different configurations is supported on a backing panel. Tyson discloses trays having back walls and bottom walls inclined upwardly from the horizontal, so that papers placed in the trays will slide towards the back wall. Tyson also claims generally J-shaped trays, at least some of which having different widths and heights being equal to multiples of a height module.

Although the organizer and management systems known in the art each have particular useful applications, they also exhibit some shortcomings. They are generally cumbersome and complex, making construction tiresome. Their physical appearance typically emphasizes structure over function, and no simple means are disclosed for the convenient layout of a system prior to the acquisition of the hardware itself.

SUMMARY OF THE INVENTION

The present invention relates to paper management and the materials, hardware, and method to design and implement a paper management system. The system allows for the initial identification of papers and the maintenance of that identification through various processing functions by providing specially configured trays or bins referred to herein as paper management means that represent specific paper management functions. The paper management functions of the present invention are: input, help, hold, output, and assist; these are the things that happen to papers and other miscellaneous work station items during processing, as distinguished from tasks. The quantity and combination of these functions is determined by the selection, orientation, and placement of the paper management means on a support panel by engaging hanging tabs depending from the bins in cross-shaped apertures in the support panel. This can be done effectively and efficiently once the user has designed and simulated the paper management system on an illustrated product development form with the use of a paper management means drawings template.

The system comprises a product development form which provides scale diagrammatic illustrations of each of the various bins which represent paper management functions. A template contains scale outline cutouts of the bins which allows the user to plan the hardware system by schematically illustrating its layout prior to actual hardware acquisition and installation. The user can illustrate the relative size, shape, orientation, and position of the paper management means representing the help, hold, input, output, and assist functions on the illustrated support panel which is schematically represented on the product development form.

In particular, the hardware includes a support panel which can be wall mounted, desk mounted, or left free standing by the use of conventional bracket and screw hardware. The support panel is a thin box whose surface is rectangular in shape and includes a square grid pattern superimposed on the surface of the panel. The panel is manufactured in sizes of three grid rows by eleven grid columns, three grid rows by seventeen grid columns, and seven grid rows by seventeen grid columns. The panel surface also contains an array of cross shaped apertures with diamond shaped interior cut outs, located at each of the intersecting grid lines, for engaging hanging tabs depending from the paper management means which perform the paper management functions. The shape of the cut outs allows the support panel to function either in a horizontal or a vertical direction, while the width of the apertures allows for up to four separate bins to engage a single aperture.

Some of the paper management means comprise trays having a single dimensionally consistent square J-shaped cross section. These trays extend from the support panel in a diagonal orientation due to the approximately 30 degree angular orientation of the hanging tabs with respect to the tray side walls. These trays or bins exhibit either a left handedness or right handedness depending on the orientation of the J-shaped side walls. The bins can be arranged, for example, in left handed and right handed vertical columns, respectively, for performing input and output functions; and in left-handed and right-handed horizontal rows, for performing help and hold functions.

Other of the paper management means are trays having three differently dimensioned square U-shaped cross sections which are sized to hold oversized computer paper, conventional forms, and the like, and other miscellaneous work station items such as calendars, address books, and so on.

The apparatus of this invention for accomplishing the disclosed processing functions is simple in structure and relatively easy to manufacture, assemble and install. The design of the hardware emphasizes the functional aspect of the system over the structural appearance of it. Papers slightly overhang the trays for easy access and structural concealment. The structure of the support panel makes the hanging and removal of the various bins relatively easy and less burdensome than in conventional type storage systems as the hanging tabs engage the apertures and are conveniently concealed in the box comprising the support panel. The ease of identification and handling of documents using the system of the present invention also makes for more productive employee time by eliminating duplicative handling and further aids in supervisory and management control by increasing employee knowledge of what is occurring as these active documents are worked on and transmitted from place to place over short periods of a few hours, or a day, and so on.

The method of the present invention follows directly from the operative features of the hardware. A user identifies the paper management system functions that will minimize the handling and rehandling of paper. These functions include, for example, help, hold, input, output, and assist. The identified functions are represented by a variety of bins which collectively are referred to as paper management means. The user traces the profile outline of selected paper management means on the illustrated support panel on the product development form using a template containing scale profile cut outs of the variously sized and shaped bins. The illustrated bins are arranged and oriented as the user chooses, and this arrangement and orientation is then duplicated when the user engages the actual paper management means in the cross-shaped apertures of the support panel. The system is used by locating a document that requires a signature, for example, in a left hand bin which represents the help function, and so on. The input function is similarly represented by the left hand bins, while the right hand bins represent the hold and output functions. The U-shaped bins represent the assist function.

Having described the various objects, advantages, and method of use of the present invention, reference is now made to the drawings, wherein:

DETAILED DESCRIPTION OF THE PREFERRED EMBODIMENT

Figure 1:
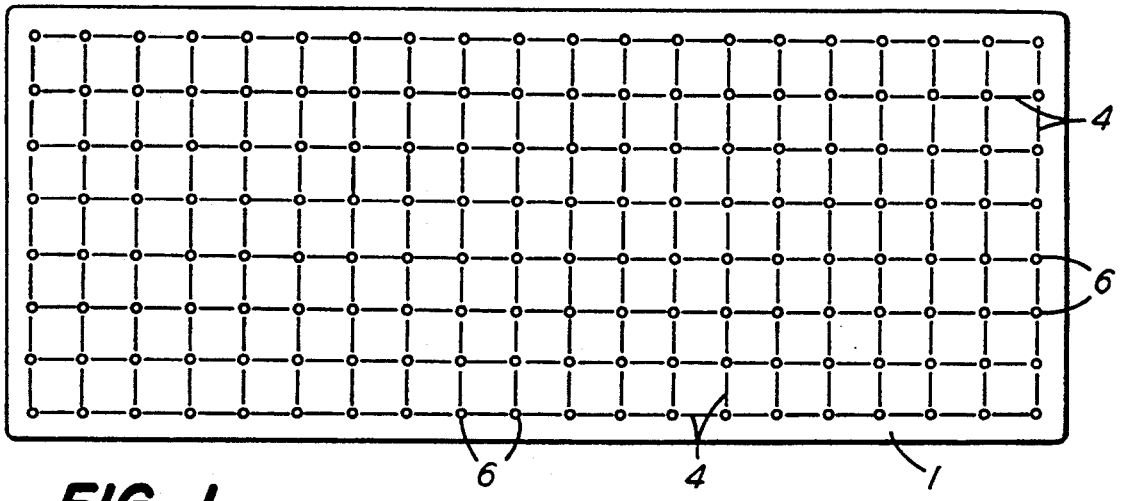
FIG. 1 is a front elevational view of the diagrammatic illustration of a large support panel as it appears on the product development form.
Figure 2:
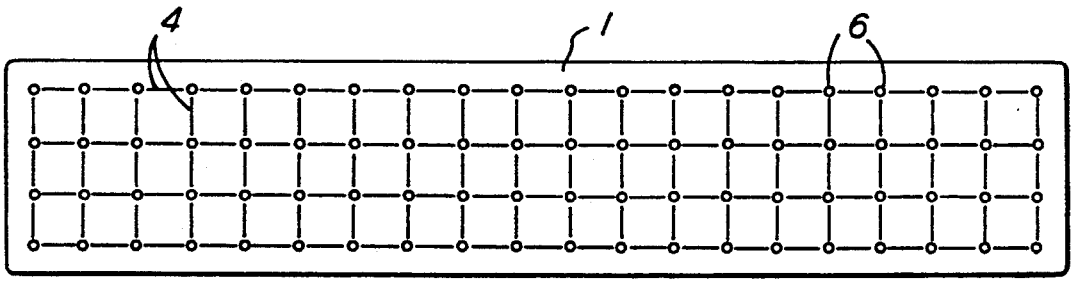
FIG. 2 is a front elevational view of the diagrammatic illustration of a long support panel, as it appears on the product development form.

With specific reference to the drawings, FIGS. 1 and 2 are diagrammatic illustrations of two sizes of the support panel 1 appearing on the product development form. A modular grid array 4 maps the surface of panel 1, and an array of points 6 occurring at each intersecting grid line 4 identifies the cross-shaped aperture locations in the support panel for receiving the hanging tabs of the paper management means, as will be further described below.

Figure 3:
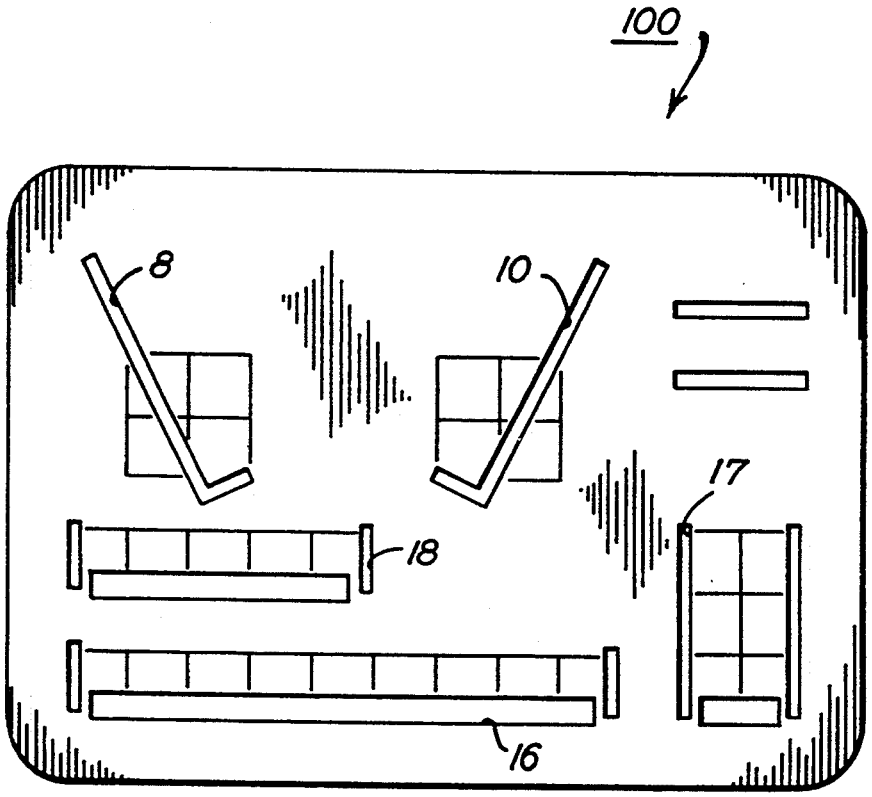
FIG. 3 is a front elevational view of the paper management function means drawing template.
Figure 4:
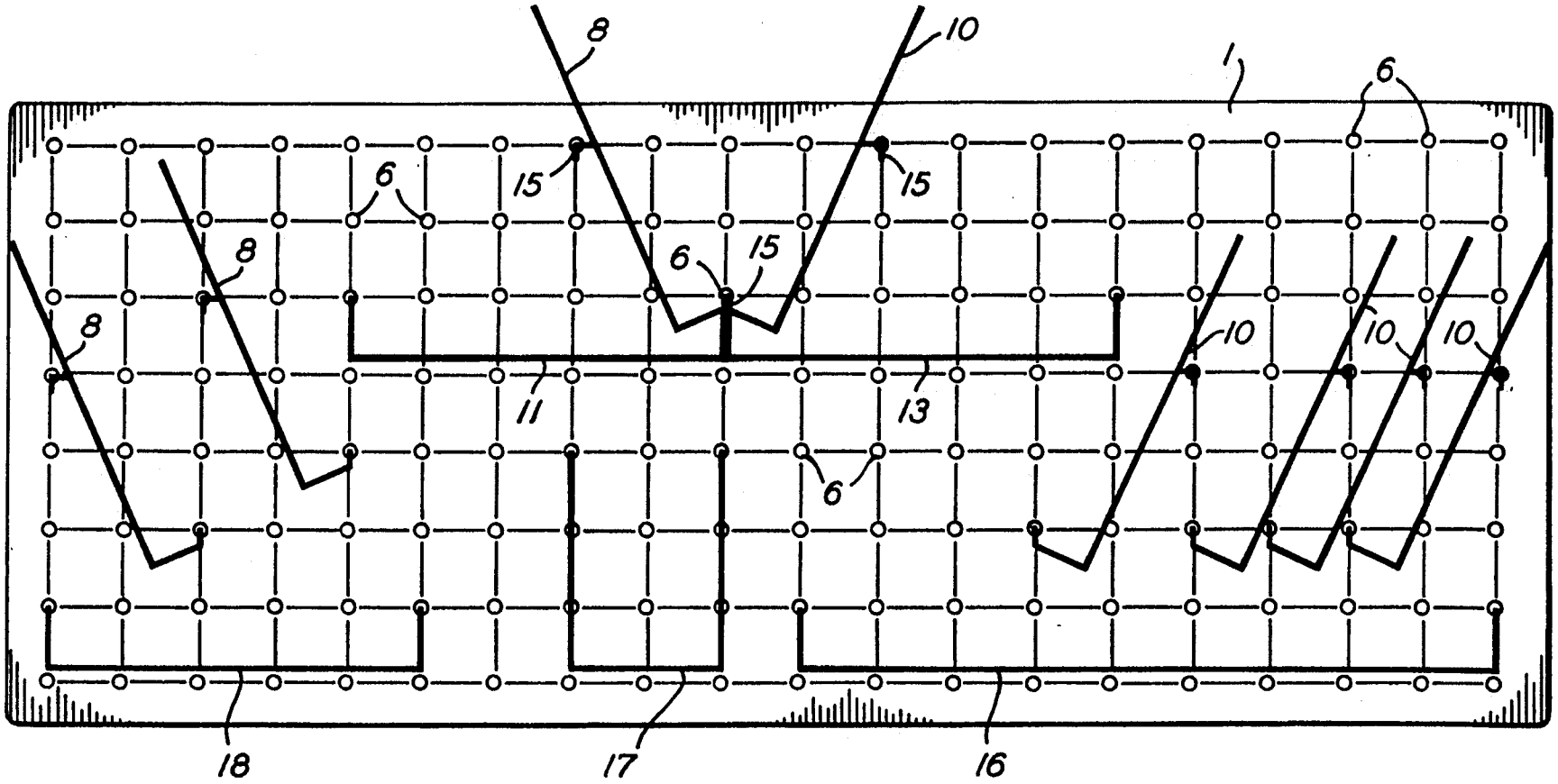
FIG. 4 is a front elevational view of a diagrammatic illustration of the paper management system as it would appear on the product development form.

Referring to FIGS. 3 and 4, a template 100 having scale cut outs of left-handed and right-handed bins 8, 10 and bins 16, 17, and 18 is positioned over the diagrammatically illustrated support panel 1 on the product development form. Line traces of bins 8, 10, 16, 17, and 18 are traced onto the illustration of the support panel such that illustrative hanging tabs 15 of the bins are located at selected illustrative aperture locations 6. This design layout lets the user plan and visualize the paper management system best suited to their needs before actually acquiring and installing specific hardware. FIG. 4 further shows a layout where up to four hanging tabs 15 of the paper management means 8, 10, 11, and 13 can share a single aperture location 6. Once the layout of the paper management system is complete, as shown in FIG. 1, the user can then proceed to construct the actual system.

Figure 5:
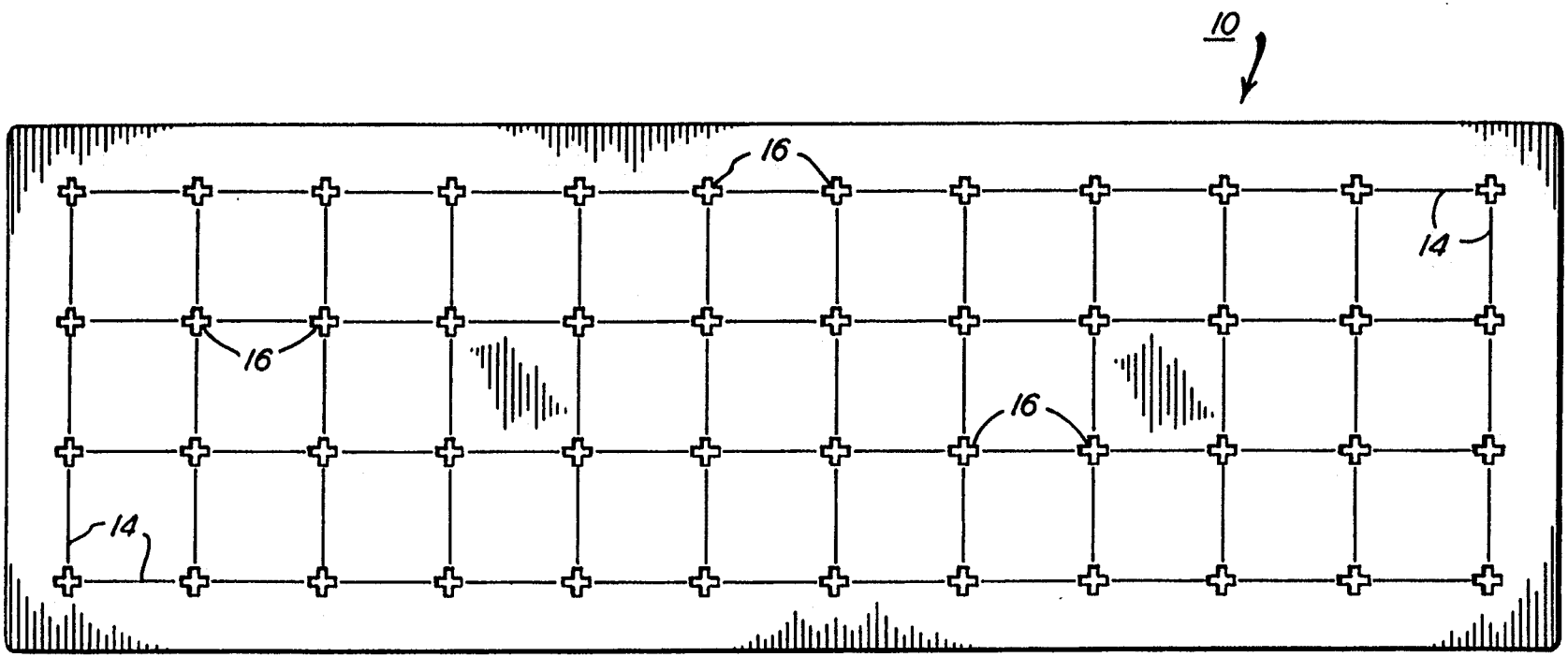
FIG. 5 is a front elevational view of the paper management system support panel.
Figure 6:
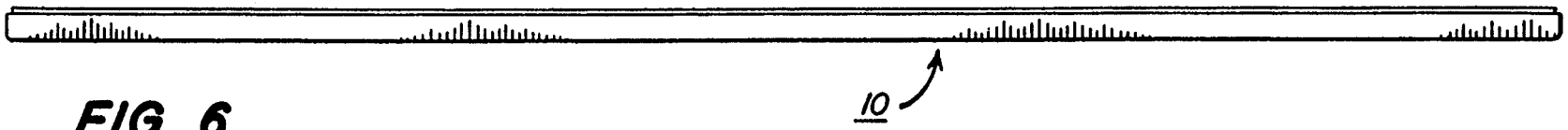
FIG. 6 is a side elevational view of the support panel of FIG. 5.
Figure 7:
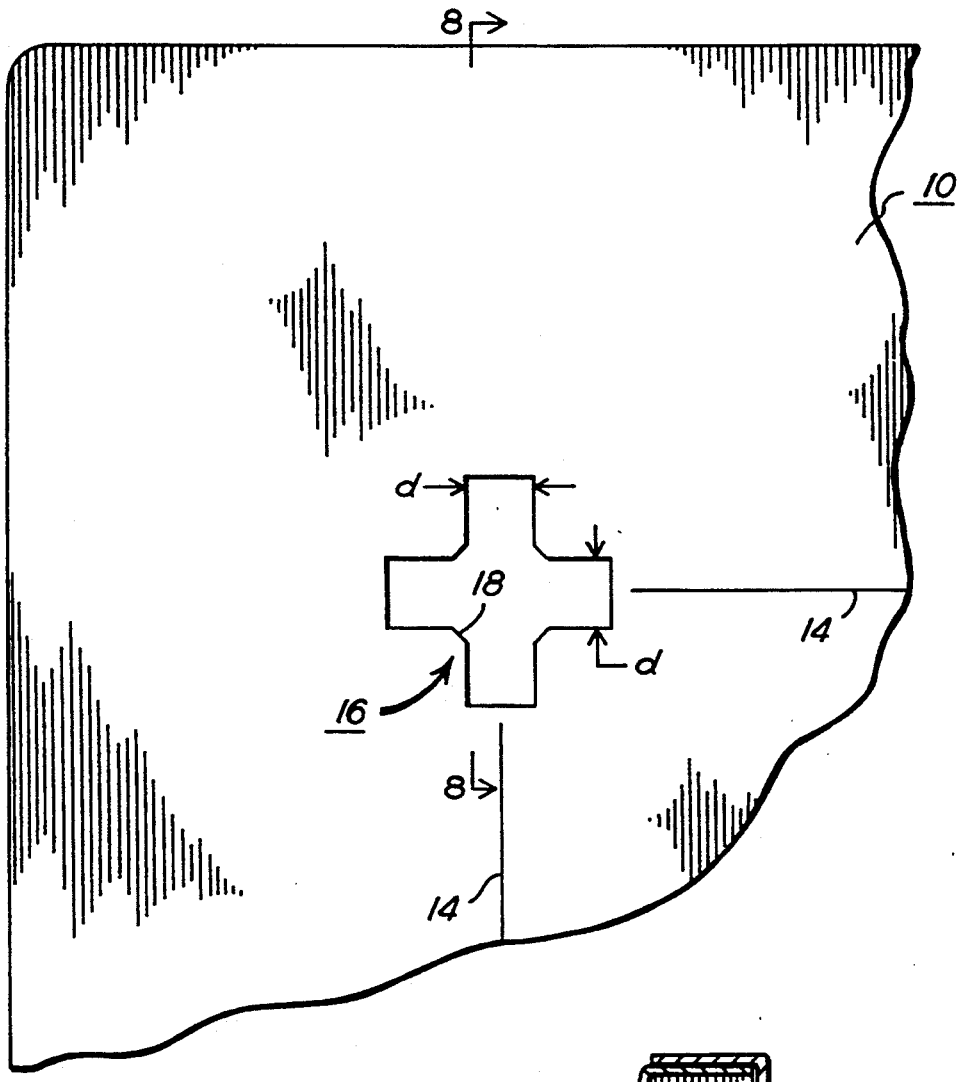
FIG. 7 is a detailed view of a generally cross shaped aperture in the support panel.
Figure 8:
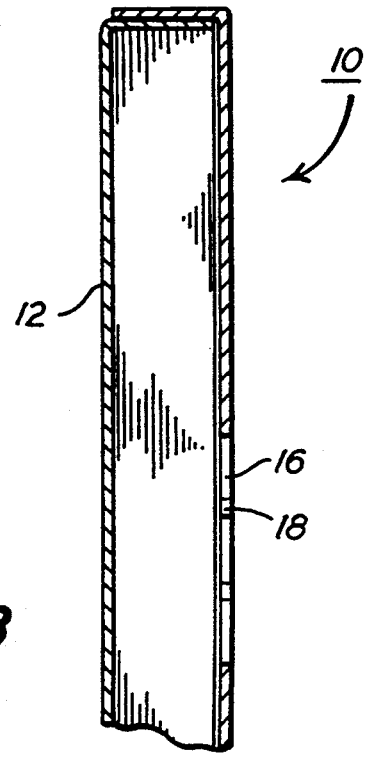
FIG. 8 is a side elevational view of the detail of FIG. 7.

A support panel 10, shown in FIG. 5, has grid lines 14 inscribed on its surface which mimic the support panel illustrated on the product development form. Cross shaped apertures 16 are located at each intersecting grid line 14 to form an array of apertures on the surface of panel 10. The detail of apertures 16 and the cooperation between the apertures and the hanging tabs 24 of the paper management means is shown, respectively, in FIGS. 7 and 9. Hanging tabs 24, being integral parts of the paper management means, are inserted into apertures 16, such insertion being aided by the modified shape of the cross apertures 18 appearing as crosses having generally diamond shaped interior apertures. Once inserted, tabs 24 are pushed downwardly to engage the support panel as shown in FIG. 8 and are concealed within the box structure of the support panel. The width d of cross aperture 16 will accommodate up to four tabs 24 of separate bins as is diagrammatically illustrated in FIG. 4.

Figure 10:
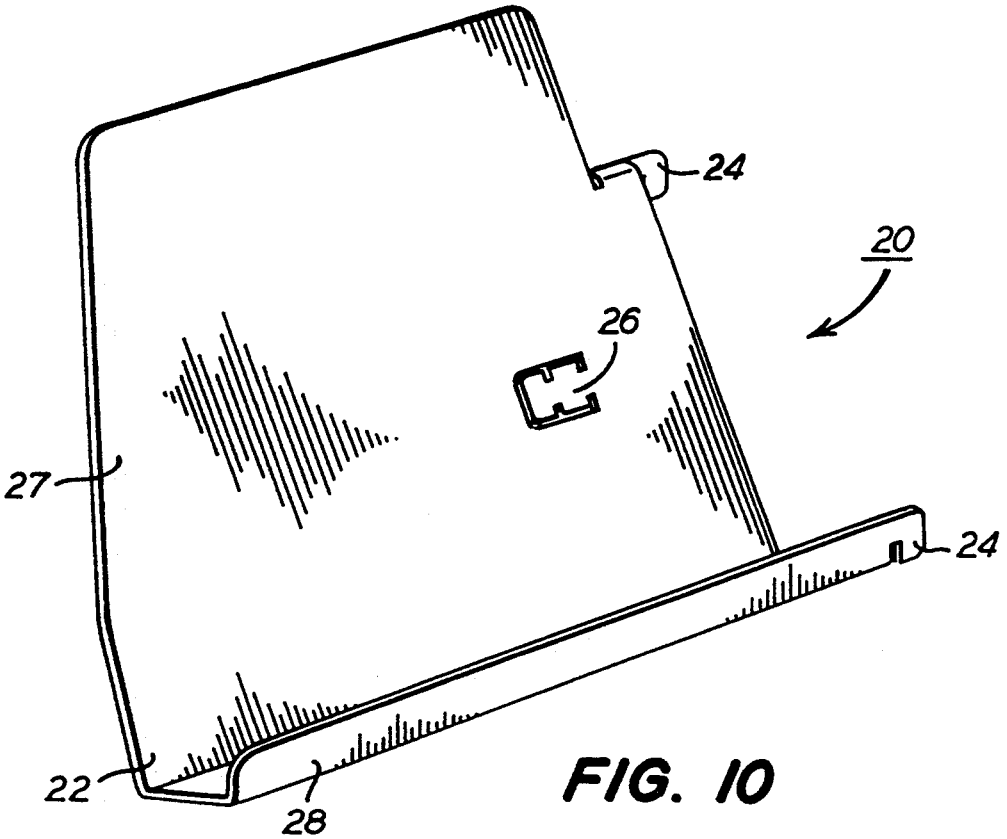
FIG. 10 is a perspective view of a left hand paper device.

FIG. 10 shows a left handed bin 20 having a generally square J-shaped cross section 22 consisting of a larger and a smaller side wall 27, 28, respectively, and a bottom panel. The larger side wall of bin 20 contains bendable tab 26. Tab 26 can be bent in two positions so that bin 20 can more conveniently accommodate less than full size documents. Hanging tabs 24 are located at the rear of large side wall 27 and short side wall 28, and are oriented with respect to the slant of side wall 27 such that when tabs 24 are engaged with panel apertures 16, the bin 20 hangs diagonally with respect to the modular grid lines 14.

Figure 9:
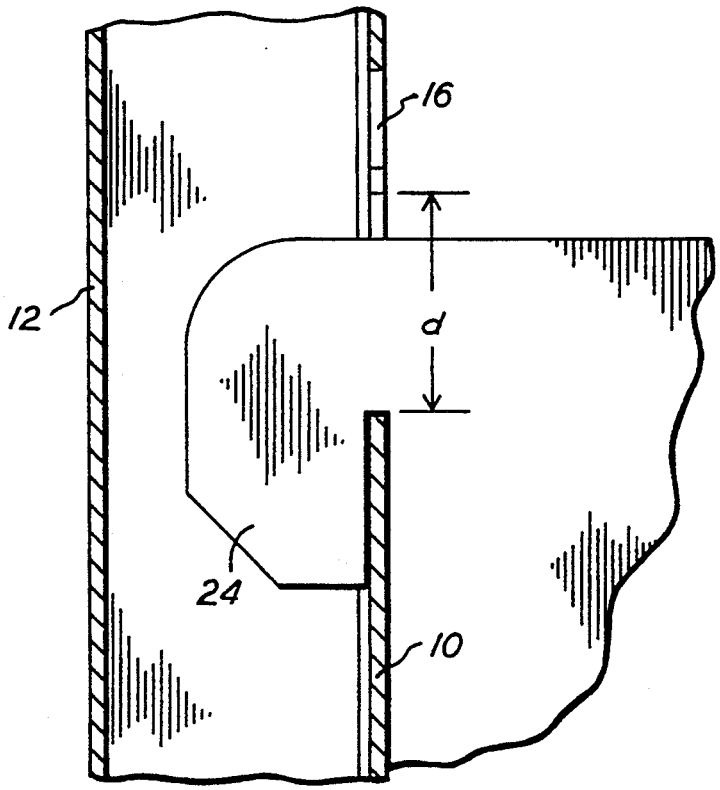
FIG. 9 is a side cross sectional view showing the engagement of a paper management function means hanging tab engaged in a support panel aperture.
Figure 11:
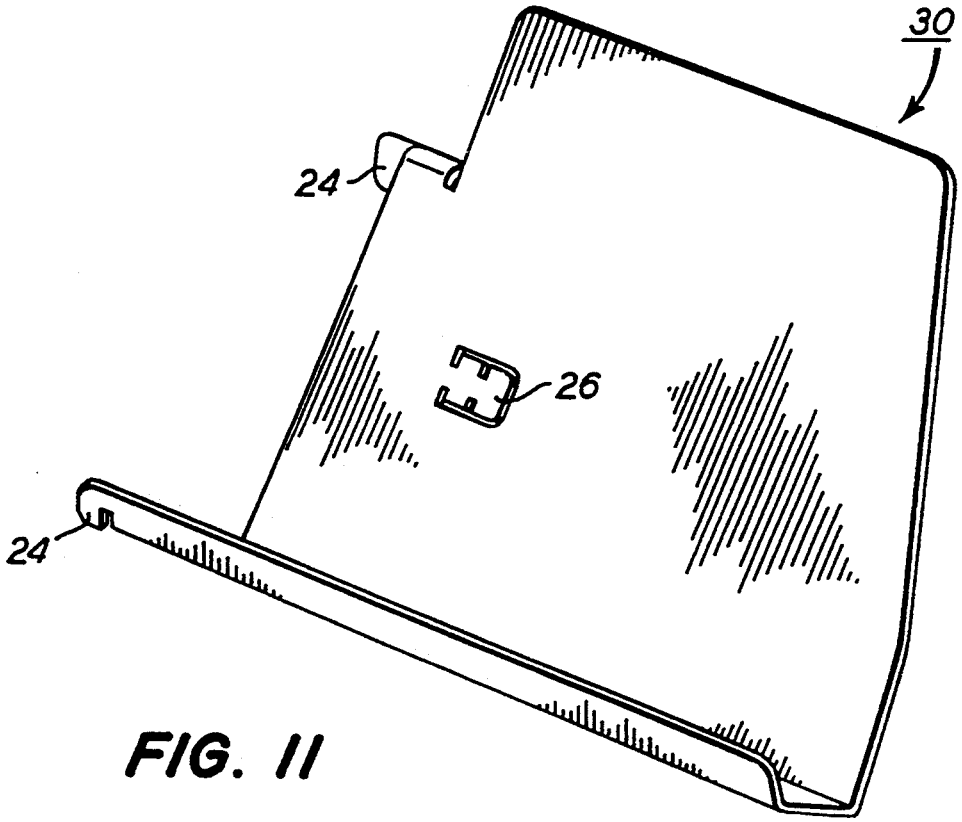
FIG. 11 is a perspective view of a right hand paper device.

FIG. 11 shows a bin 30 identical to that shown in FIG. 9, except that bin 30 has a right handed orientation with respect to its installed position on a support panel.

Figure 12:
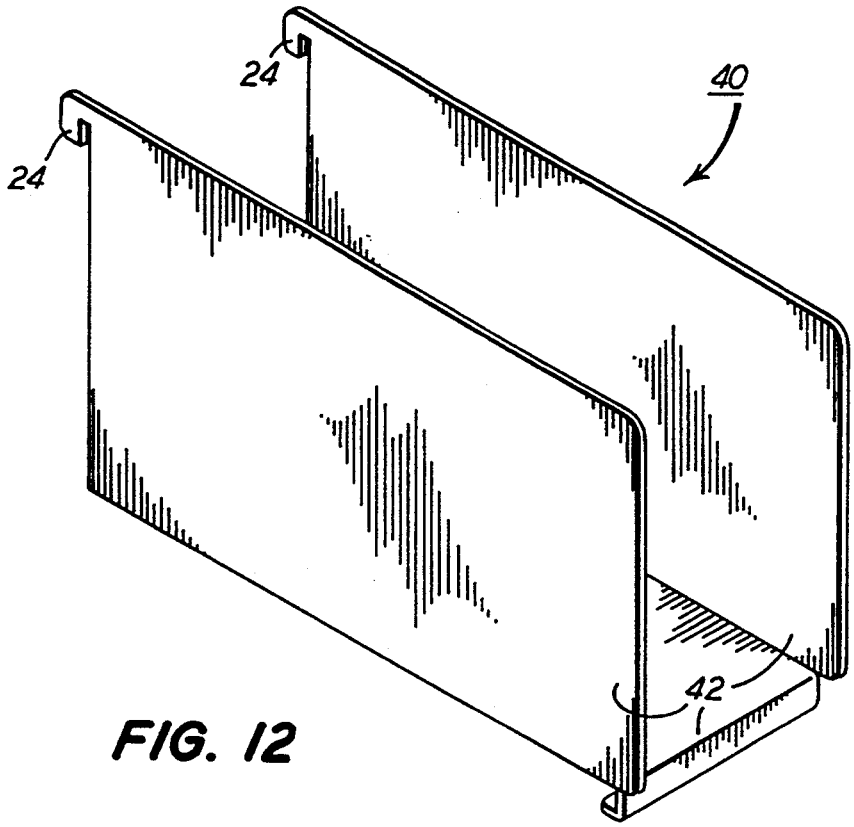
FIG. 12 is a perspective view of an assist device.
Figure 13:
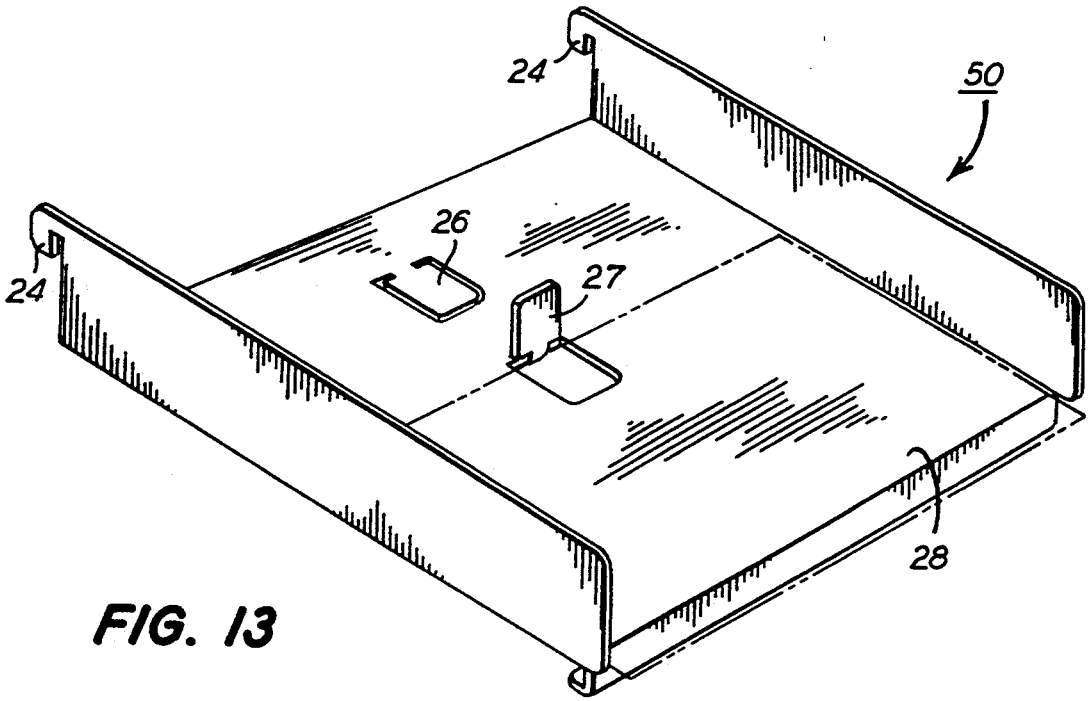
FIG. 13 is a perspective view of an assist device.
Figure 14:
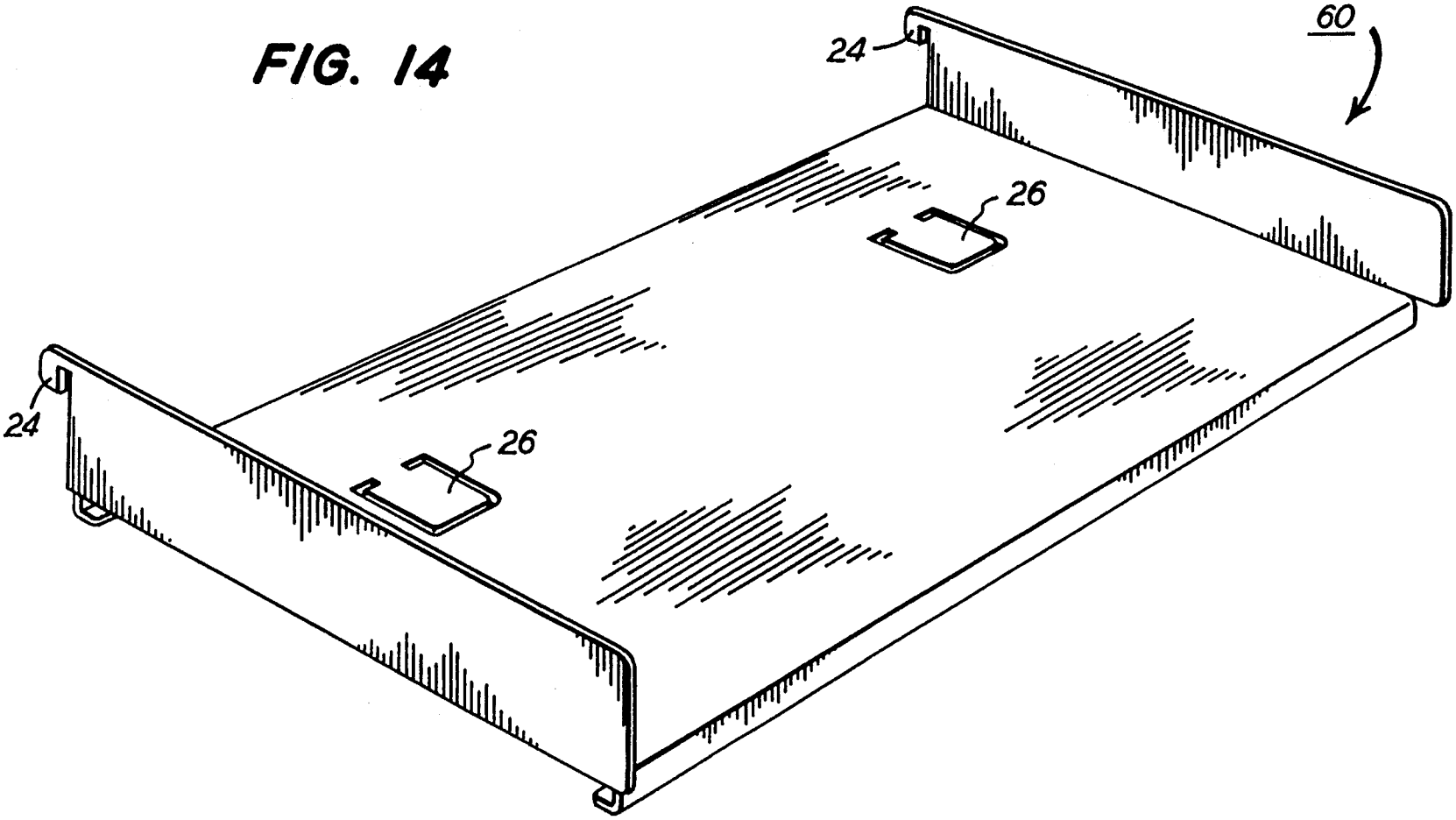
FIG. 14 is a perspective view of an assist device.

FIGS. 12, 13, and 14 show bins 40, 50, and 60, respectively. These bins are generally square U-shaped and consist of two opposing side walls and a bottom panel. Hanging tabs 24 extend from each of the rear side walls. Bins 50, 60 further include bendable tabs 26 for accommodating undersized documents. FIG. 13 shows tab 27 in the bent position and a phantom undersized paper 28 located conveniently in the bin.

Figure 15:
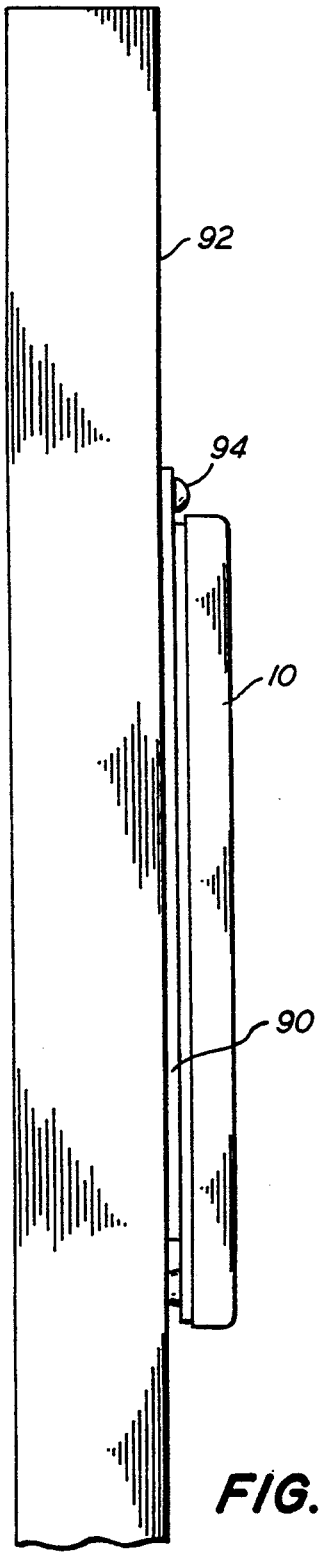
FIG. 15 is a side elevational view of a wall mounted support panel.

In a preferred embodiment of the present invention seen in side view in FIG. 15, support panel 10 is connected to wall bracket 90 and the assembly is further mounted to a wall 92 by conventional screw means 94.

Figure 16:
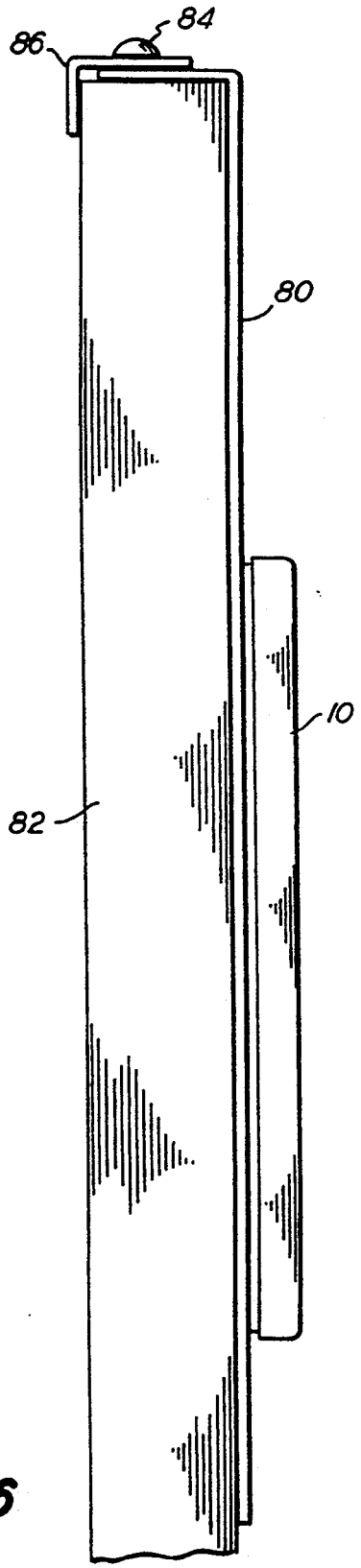
FIG. 16 is a side elevational view of a partition mounted support panel.

FIG. 16 shows an alternative embodiment of the present invention wherein panel 10 is attached to bracket 80 which is adjustably attached to bracket 86 by conventional slot and screw means 84. The assembly is hung over partition 82 by bracket assembly 80, 86.

Figure 17:
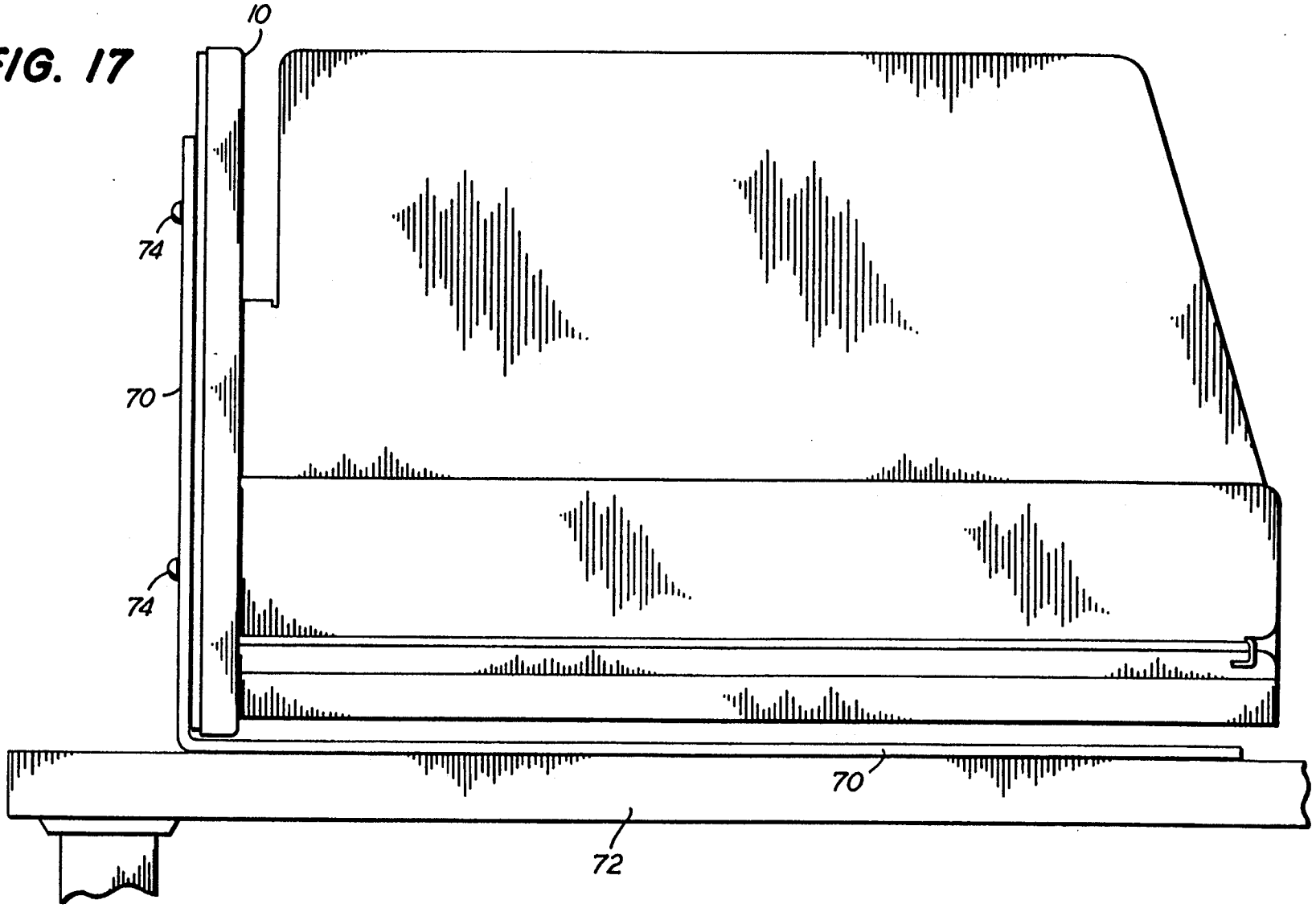
FIG. 17 is a side elevational view of a support panel free standing on a flat surface.

Another alternative embodiment of the present invention, shown in FIG. 17, discloses right hand bin 30 and assist bin 50 engaged with support panel 10, the system being further attached to bracket 70 by screw means 74 for providing free standing support to the system on a flat surface 72.

For each of the embodiments described, a paper management system is diagrammatically laid out on the product development form with the aid of the template. The metal support panel is then mounted as desired and the paper management means are hung from the support panel by engaging the hanging tabs of these bins in the support panel apertures according to the system configuration identified in the product development layout.

Actual use of the paper management system is clear from the foregoing description. Once the paper management means are identified by the user as supporting a particular management function, such as input, help, hold, and output, for example, re handling of papers can be greatly reduced and the efficiency of processing greatly increased by the specific functional identification of the documents provided by the paper management system herein disclosed.

While the embodiments of the above paper management system have been described in detail with reference to the attached drawings figures, it is understood that various changes and adaptations may be made in the paper management system without departing from the spirit and scope of the appended claims.

What is claimed is:

1. A manual paper management system for identifying and processing documents and organizing miscellaneous work station items comprising:

a support panel having a plurality of generally cross-shaped apertures each of the plurality of apertures having sufficient width for engaging up to four separate hanging tabs;

paper management means for identifying paper management functions, having hanging tabs for releasably engaging the cross-shaped apertures; and support means for supporting the support panel.

2. The system of claim 1 where the apertures are symmetrical.

3. A manual paper management system for identifying and processing documents and organizing miscellaneous work station items comprising:

a box having a rectangular surface having a plurality of generally cross-shaped apertures and including indicia for locating the aperture:

paper management means for identifying paper management functions, having hanging tabs for releasably engaging the cross-shaped apertures; and support means for supporting the box.

4. The paper management system of claim 1 wherein the support panel, the paper management means, and the panel support means are fabricated in metal.

5. A manual paper management system for identifying and processing documents and organizing miscellaneous work station items comprising:

a support panel having an array of generally cross-shaped apertures;

a plurality of paper management means for identifying paper management functions, having hanging tabs for cooperatively engaging the cross-shaped apertures;

support means attachable to the support panel for supporting the support panel;

a product development form schematically related to the support panel illustrating the support panel for planning and layout of the paper management system prior to system acquisition and installation;

drawing means for making profile drawings of the paper management means on the product development form.

6. The paper management system of claim 5 wherein the drawing means comprises a template having scale profile cutouts of the paper management means which match the dimensions of the illustrated product development form.

7. The paper management system of claim 5 where the paper management means comprise a plurality of bins.

8. The system of claim 7 where at least some of the bins comprise dimensionally invariant generally square J-shaped trays each having a short and a long side wall and a bottom wall connecting the side walls, and a generally L-shaped hanging tab depending from the rear edge of each side wall; further wherein the bins represent paper management functions selected from a group of functions consisting of input, help, hold, and output.

9. The system of claim 8 where each hanging tab is disposed at an angle of about 30° to planes containing the side walls for hanging each bin in a diagonal plane which is normal to the surface of the panel.

10. The system of claim 8 where the bins have either a left hand or right hand orientation, each of the left hand bins having the long side wall to the left of the short side wall and each of the right hand bins having the long side wall to the right of the short side wall.

11. The system of claim 7 where at least some of the bins comprise generally square U-shaped trays having opposing side walls and a bottom wall connecting the side walls, and a generally L-shaped hanging tab depending from the rear edge of each side wall.

12. The system of claim 5 where each of the plurality of apertures have widths for engaging up to four separate hanging tabs.

13. The system of claim 5 where the apertures are symmetrical.

14. The system of claim 5 wherein the support panel comprises a box having a rectangular surface including indicia means for locating the apertures.

15. The system of claim 14 where the hanging tabs are enclosed in the box upon engaging the cross-shaped apertures.

16. The system of claim 14 where the indicia means comprise intersecting horizontal and vertical lines forming a square grid, wherein each of the plurality of apertures are located at the intersection of a pair of the grid lines forming a regular array of apertures over the surface of the support panel.

17. The system of claim 5 where the support means comprises a pair of flat brackets attaching to the rear of the panel for attaching the panel to a wall.

18. The system of claim 5 where the support means comprise a pair of L-shaped brackets attaching to the rear of the panel for supporting the system on a flat surface in a free standing position.

19. The system of claim 5 where the support means comprise a pair of L-shaped brackets having a slot and screw adjustment and attaching to the rear of the panel for hanging the panel from a partition having a variable width.

20. The paper management system of claim 5 wherein the support panel, the paper management means, and the panel support means are fabricated in metal.

21. A method of manual paper management comprising the steps of:

a) identifying a plurality of paper management functions;

b) diagrammatically laying out a paper management system on a product development form;

c) installing support means to the rear of a box including a rectangular support panel having an array of cross-shaped apertures;

d) engaging paper management means in the cross-shaped apertures according to the system layout on the product development form;

e) locating documents or miscellaneous work station items in the appropriate paper management means which are represented by a plurality of generally square J-shaped bins having either a left hand or a right hand orientation, and in generally square U-shaped bins.

22. The method of claim 21 where the step of identifying paper management functions comprises the step of selecting paper management functions from a group of paper management functions consisting of input, help, hold, output, or assist.

23. The method of claim 21 where the step of diagrammatically laying out a paper management system on a product development form comprises the step of using a paper management means template to illustrate paper management means on the product development form.

24. The method of claim 21 where the step of installing support means to a box comprises the step of attaching a pair of mounting brackets to the rear of the box for mounting the support panel to a wall or a partition or for free standing on a flat surface.

25. The method of claim 21 where the step of locating documents or miscellaneous work station items in the appropriate paper management means comprises the step of locating items requiring the input or help functions in left hand bins; locating items requiring the hold or output functions in right hand bins; and locating items requiring the assist function in generally U-shaped bins.

26. A manual paper management system for identifying and processing documents and organizing miscellaneous work station items comprising:

a support panel having a plurality of generally cross-shaped apertures;

paper management means for identifying paper management functions, said paper management means having hanging tabs for releasably engaging the cross-shaped apertures, said paper management means further including a plurality of bins wherein at least some of the bins comprise dimensionally invariant, generally square, J-shaped trays each having a short and a long side wall and a bottom wall connecting the side walls, and a generally L-shaped hanging tab depending from the rear edge of each side wall; and support means for supporting the support panel.

27. The manual paper management system of claim 26 wherein each hanging tab is disposed at an angle of about 30° to planes containing the side walls for hanging each bin in a diagonal plane which is normal to the surface of the support panel.

28. The manual paper management system of claim 26 wherein the plurality of bins have one of a left hand and a right hand orientation, each of the left hand bins having the long side wall to the left of the short side wall and each of the right hand bins having the long side wall to the right of the short side wall.

29. A manual paper management system for identifying and processing documents and organizing miscellaneous work station items comprising:

a support panel having a plurality of generally cross-shaped apertures;

paper management means for identifying paper management functions, said paper management means having hanging tabs for releasably engaging the cross-shaped apertures, said paper management means further including a plurality of bins wherein at least some of the bins comprise generally square, U-shaped trays each having opposing side walls and a bottom wall connecting the side walls, and a generally L-shaped hanging tab depending from the rear edge of each side wall; and support means for supporting the support panel.

30. A manual paper management system for identifying and processing documents and organizing miscellaneous work station items comprising:

a support panel having a plurality of generally cross-shaped apertures;

paper management means for identifying paper management functions, having hanging tabs for releasably engaging the cross-shaped apertures; and a pair of flat brackets attaching to the rear of the support panel for attaching the support panel to a wall.

31. A manual paper management system for identifying and processing documents and organizing miscellaneous work station items comprising:

a support panel having a plurality of generally cross-shaped apertures;

paper management means for identifying paper management functions, having hanging tabs for releasably engaging the cross-shaped apertures; and a pair of L-shaped brackets attaching to the rear of the support panel for supporting the system on a flat surface in a free standing position.

32. The system of claim 31 where the pair of L-shaped brackets have a slot and screw adjustment for hanging the support panel from a partition having a variable width.

33. A manual paper management system for identifying and processing documents and organizing miscellaneous work station items comprising:

a support panel having a rectangular surface having a plurality of generally cross-shaped apertures and including indicia for locating the apertures;

paper management means for identifying paper management functions, said paper management means having hanging tabs for releasably engaging the cross-shaped apertures, wherein the hanging tabs are enclosed within the support panel upon engaging the apertures; and support means for supporting the support panel.

34. A manual paper management system for identifying and processing documents and organizing miscellaneous work station items comprising:

a support panel having a rectangular surface having a plurality of generally cross-shaped apertures and including indicia for locating the apertures, said indicia comprising intersecting horizontal and vertical lines forming a square grid, wherein each of the plurality of apertures is located at the intersection of a pair of the grid lines forming a regular array of apertures over the surface of the support panel;

paper management means for identifying paper management functions, said paper management means having hanging tabs for releasably engaging the cross-shaped apertures; and support means for supporting the support panel.

* * * * *